US005447312A

United States Patent [19]

Nixon et al.

[11] Patent Number: 5,447,312

[45] Date of Patent: Sep. 5, 1995

[54] FULL GOLF SWING TRAINING DEVICE

[75] Inventors: William L. Nixon, Salt Lake City; Kimball R. Thompson, American Fork; James R. Chidester, Highland, all of Utah

[73] Assignee: Pro-Wedge, Inc., Sandy, Utah

[21] Appl. No.: 319,539

[22] Filed: Oct. 7, 1994

Related U.S. Application Data

[63] Continuation-in-part of Ser. No. 161,235, Dec. 2, 1993, abandoned.

[51] Int. Cl.[6] ..... A63B 69/36

[52] U.S. Cl. ..... 273/187.2; 273/189 R; 273/DIG. 30

[58] Field of Search ..... 273/187.2, 187.4, 187.5, 273/189 R, 189 A, DIG. 30, 165, 191 R, 192, 194 R

[56] References Cited

U.S. PATENT DOCUMENTS

| | | | |
|---|---|---|---|
| 3,595,583 | 7/1971 | Oppenheimer | 273/191 R |
| 3,861,688 | 1/1975 | Butler | 273/187 R X |
| 4,058,852 | 11/1977 | Aragona | 2/115 |
| 4,173,344 | 11/1979 | Angshed | 273/187.2 |
| 5,005,833 | 4/1991 | Groveman et al. | 273/187.2 X |
| 5,154,416 | 10/1992 | Smull et al. | 273/187.2 X |
| 5,259,621 | 11/1993 | Keefer | 273/187.2 |

OTHER PUBLICATIONS

Lyons, "Instant Lesson," *Golf Digest*, Nov., 1974, p. 68.

*Primary Examiner*—George J. Marlo

*Attorney, Agent, or Firm*—Sterne, Kessler, Goldstein & Fox

[57] ABSTRACT

A golf swing training device for setting and maintaining proper arm position throughout a full golf swing teaches a proper golf swing by forcing a golfer to keep his or her arms in plane during the entire swing. The device includes a restraining wedge for maintaining a triangle between the forearms of the golfer when the wedge is held between the golfer's forearms. The restraining wedge is attached to the golfer's forearms by means of two forearm cuffs. Each forearm cuff can be placed on a forearm of the golfer without the assistance of another person. The forearm cuffs are then secured into the restraining wedge by, for example, a hook and loop fastener. The training device maintains the forearms in a skewed position which allows a full unrestricted golf swing.

25 Claims, 10 Drawing Sheets

FULL GOLF SWING TRAINING DEVICE

RELATED APPLICATION

This application is a continuation-in-part of U.S. patent applications Ser. No. 08/161,235, filed on Dec. 2, 1993, now abandoned.

BACKGROUND OF THE INVENTION

1. Field of the Invention

The invention relates to the field of golf training devices and, more particularly, to a golf training device for setting and maintaining proper arm positioning throughout a full golf swing.

2. Related Art

Proper grip, stance, and alignment are critical to setting up a proper golf swing. In addition, minor variations in the dynamics of a golfer's swing can have pronounced effects on the path and distance travelled by the ball. For a proper swing, it is important that proper body positioning and arm positioning be maintained through the full golf swing.

It is desirable to have a training aid which can teach proper arm positioning during set up and throughout a full swing. A variety of golf training aids are known. However, none teaches proper arm positioning throughout the full swing. For example, many putting and chipping training aids are known. Generally, these devices secure the wrists of a golfer together to teach the straight-armed pendulum like motion required for a chip or a put. U.S. Pat. No. 5,259,621 to Keefer discloses such a device. In addition to restraining the golfer's arms, the Keefer device also attaches to the golf club.

Putting/chipping training devices such as that disclosed by Keefer suitably restrain a golfer's arms for putting or chipping. However, the straight-arm position of a chip or a put is not suitable for a full swing.

Other training devices are also known. For example, U.S. Pat. No. 3,595,583 to Oppenheimer discloses a complex golf swing training device into which a club and a golfer are placed. The machine connects to the golfer and the club by means, for example, of a series of cables and pulleys to restrict various movements during the golf swing.

U.S. Pat. No. 4,058,852 to Aragona discloses a shirt with hook and loop fasteners in the upper chest and arm area for holding the golfer's arm in a fixed position relative to the chest. This device does not restrict movement of the forearms and appears to restrict a full golf swing.

U.S. Pat. No. 3,861,688 to Butler discloses a device for providing feedback to the golfer regarding the relative position of portions of her body. This device, however, provides no restriction on a golfer's arm or body positioning.

David Ledbetter's "SwingLink" device, commercially available through advertisements in golfing magazines and in most golfing shops, is a strap which the golfer places around her shoulders and upper arms. The device appears to be intended to restrict certain arm movements to teach proper arm positioning during golf swing. However, the device provides no restriction on the forearms, which may be rotated or separated to the detriment of the golf swing. In addition, the SwingLink device limits the golf swing to approximately a three-quarter swing.

What is needed is a training device which can be used for a full golf swing. Such a device should restrain arm position so that only a proper swing can be executed so that the golfer may be taught muscle memory so that he may eventually execute the swing without the training device and thus improve her golf game.

SUMMARY OF THE INVENTION

The invention is a golf swing training device for setting and maintaining proper arm position throughout a full golf swing teaches a proper golf swing by forcing a golfer to keep her arms in plane during the entire swing. The device includes a restraining wedge for maintaining a triangle between the forearms of the golfer when the wedge is held between the golfer's forearms. The restraining wedge is attached to the golfer's forearms by means of two forearm cuffs. Each forearm cuff can be placed on a forearm of the golfer without the assistance of another person. The forearm cuffs are then secured into the restraining wedge by, for example, a hook and loop fastener.

In the preferred embodiment, the exterior surface of each forearm cuff is covered with a loop (or hook) material of a hook and loop fastener. Correspondingly, the mating surfaces of the restraining wedge are covered with a hook (or loop) material of a hook and loop fastener. Thus, once the forearm cuffs are properly positioned around the forearms of the golfer, the forearm cuffs may be secured to the restraining wedge simply by pressing them into place against the restraining wedge such that the loop material mates with the hook material. In the preferred embodiment, the restraining wedge includes two forearm cups which are secured together by a wedge element. The hook material of the hook and loop fastener is disposed on the inner surface of each forearm cup.

The restraining wedge secures the arms of the golfer into position such that the axes defined by the golfer's forearms are skew. That is, they are not parallel and do not intersect. The axes are separated by an inclination angle defined by the triangle formed by the forearms of the golfer in a first dimension and by a skew angle defined by the skewing of one arm with respect to the other in a second dimension. That the arms are held in a skew position is important to permitting a full golf swing.

In a first embodiment, the restraining wedge is not adjustable and the inclination and skew angles are fixed. Different sized golfers can be accommodated by moving the position of the restraining wedge either up or down on the forearms. This embodiment of the invention can accommodate a range of different body sizes. To expand that range, the restraining wedge may be produced in different sizes and angles to accommodate different golfers.

In a second embodiment of the invention, the inclination angle, the skew angle, as well as the separation between the forearm receiving cuffs are fully adjustable. In this embodiment, the wedge element of the restraining wedge includes a first structural member attached to an outer side of a first forearm cup, a second structural member attached to an outer side of the second forearm cup, a key, a bolt, a coil spring and a threaded knob. The first structural member is attached to the first forearm cup by a pivot pin at a first end and a bolt and slot arrangement at a second end. This allows the angle the forearm cuff to be adjusted with respect to the structural member to alter the skew angle of the restraining wedge.

The coil spring and the key are disposed between the first and second structural members. The bolt is passed through a hole in a medial portion of the first structural member, a hole in the key, the coil spring and a slot in a medial portion of the second structural member. The threaded knob is then threaded onto the bolt to secure the first and second structural members together. A shank portion of the key mates with a slot in the second structural member and ridges on an opposite side of the key mate with ridges on an inner surface of the first structural member when the first and second structural members are brought together by the bolt and threaded knob. These features of the key secure the first and second structural members together and prevent slippage without requiring excessive tightening of the knob.

Adjustment of inclination angle is achieved by pivoting one structural member with respect to the other about the bolt. The distance between the forearm receiving cuffs may be adjusted by sliding the bolt in the slot of the second structural member.

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENT

The preferred embodiment of the invention is discussed in detail below. While specific part numbers and/or configurations are discussed, it should be understood that this is done for illustration purposes only. A person skilled in the relevant art will recognize that other components and configurations may be used without parting from the spirit and scope of the invention.

The preferred embodiment of the invention is now described with reference to the figures where like reference numbers indicate like elements. Also in the figures, the left most digits of each reference number corresponds to the figure in which the reference number is first used.

Figure 1:
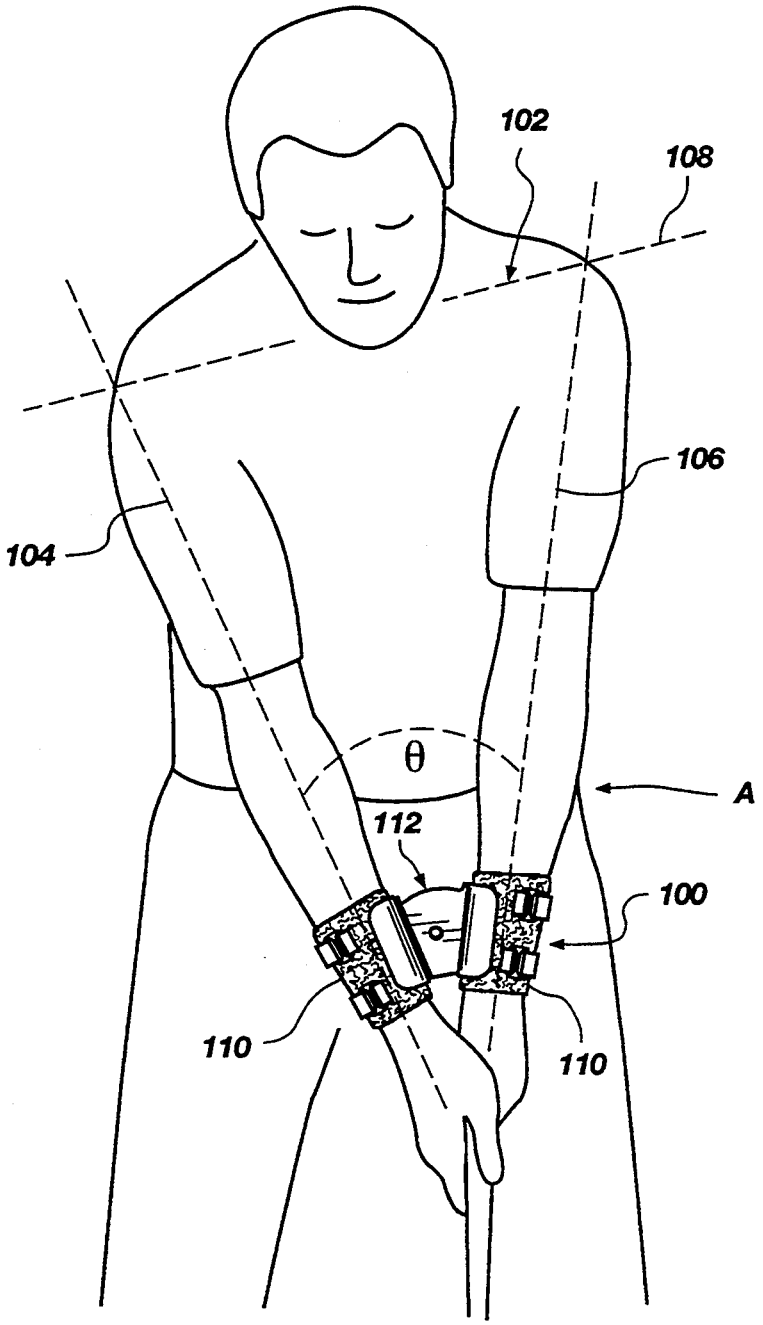
FIG. 1 illustrates a right handed golfer wearing a full golf swing training device 100 of the invention and illustrates the triangle formed by the forearms and shoulders of the golfer.

FIG. 1 illustrates a right handed golfer wearing a full golf swing training device 100 of the present invention. Training device 100 maintains a golfer's arms in the proper position for a full golf swing. A full golf swing includes the entire back swing as well as the follow through. As illustrated in FIG. 1, proper arm positioning at set up results in a triangle 102 being formed between the golfer's arms and shoulders. Triangle 102 includes a first side defined by a first axis 104 through the right arm, a second axis 106 through the left arm and a third axis 108 through the golfer's shoulders. A proper golf swing requires this triangle to be maintained (at least with respect to the forearms) throughout the entire swing. Training device 100 assures that this happens.

As illustrated in FIG. 1, axis 104 forms an angle $\theta$ with axis 106 in a plane approximately formed by the forearms of the golfer. Note, however, that axes 104,106 are skew. By "skew," it is meant that axes 104,106 are not parallel and do not intersect. Thus, triangle 102 is not a true triangle since two of its sides, axes 104,106, do not intersect. However, for purposes of describing the invention, a triangle is approximately or roughly formed and, as discussed in detail below, approximately defines a plane.

Angle $\theta$ is defined as the between axis 106 and a line through one of its points parallel to axis 104 (since axes 104,106 do not actually intersect) when viewed from the front of the golfer (i.e., from a point perpendicular to the plane defined by triangle 102). Angle $\theta$ is defined herein as the inclination angle.

Figure 2:
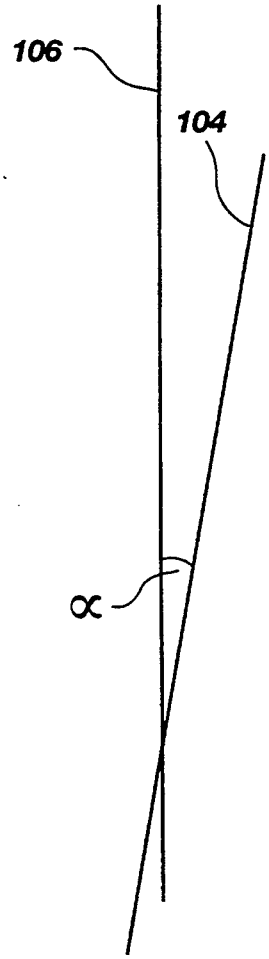
FIG. 2 is a diagram illustrating the relationship between the axes of the golfer's arms of FIG. 1 when viewed from the direction indicated by Arrow A in FIG. 1.

Because axes 104,106 are skew, they also form an angle with respect to each other that prevents them from lying in a true plane. This is illustrated in FIG. 2. FIG. 2 illustrates the spacial relationship between axes 104,106 as viewed from the left side of the golfer as indicated by arrow A in FIG. 1. When viewed from this dimension, axes 104,106 form a skew angle $\alpha$. Skew angle $\alpha$ is defined as the angle between axis 106 and a line through one of its points parallel to axis 104 (since axes 104,106 do not actually intersect). To facilitate a full golf swing, it is important that skew angle $\alpha$ is not equal to zero.

When properly gripping a golf club for a full swing, the forearm of the golfer's dominant arm (e.g., left arm for a left handed golfer or right arm for a right handed golfer) must be angled or skewed up with respect to the other forearm. That is, the skew angle may be envisioned as being formed by pivoting the dominant forearm with respect to the plane of triangle 102 so that the dominant elbow moves down while the dominant hand moves up with respect to a pivot point at training device 100.

Note that during set up, as illustrated in FIG. 1, the right handed golfer's left arm is nearly vertical and the elbow straight, while the right arm is set back from vertical and the elbow slightly bent. Thus, while a triangle is discussed, the triangle that is formed primarily includes the forearms of the golfer rather than her entire arms. During the back swing and follow through portions of a full golf swing, both of the golfer's elbows are bent. However, the triangle is maintained at least with respect to the golfer's forearms.

As discussed in greater detail below, training device 100 allows inclination angle $\theta$ and skew angle $\alpha$ to be adjusted to match needs of particular golfers. For example, inclination angle $\theta$ can be adjusted to accommodate different sized golfers. As can be seen through inspection of FIG. 1, as the shoulder width and arm length of a golfer is changed, inclination angle $\theta$ must be adjusted accordingly.

Turning again to FIG. 1, training device 100 includes two forearm cuffs 110 and a restraining wedge 112. Each forearm cuff 110 is configured to be securely wrapped around a forearm of the golfer. Each forearm cuff 110 is then coupled to restraining wedge 112 to secure the golfer's arms into proper position.

Figure 3:
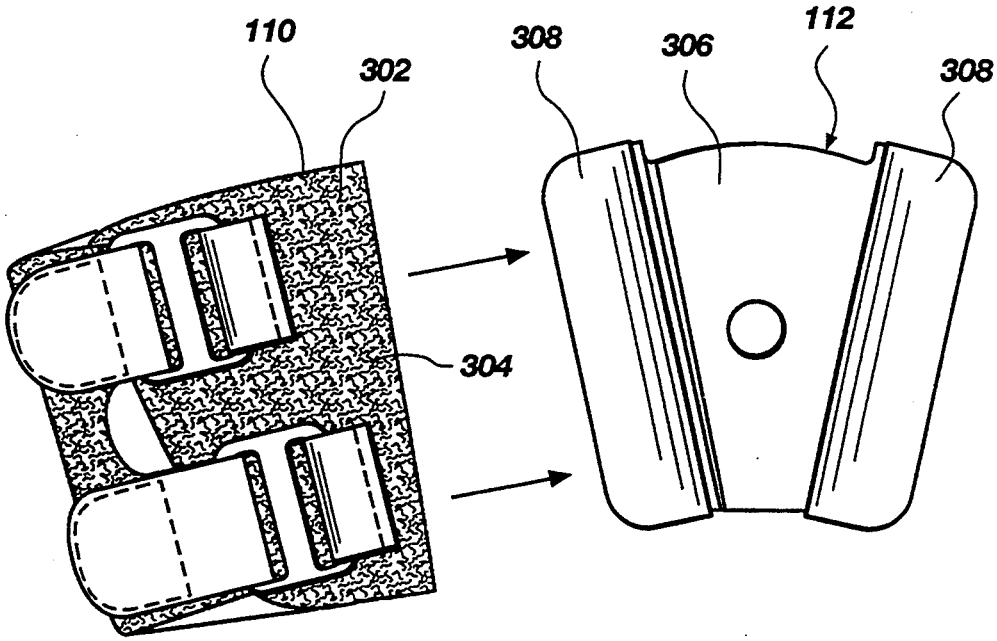
FIG. 3 illustrates the restraining wedge and forearm cuff of the invention.

As illustrated in FIG. 3, in the preferred embodiment, each forearm cuff 110 is configured to be removably attached to restraining wedge 112. Forearm cuff 110 is removably attached to restraining wedge 112 by means of a securing element such as a hook and loop fastener. In the preferred embodiment, the exterior surface 302 of each forearm cuff 110 is covered with a loop (or hook) material 304 of a hook and loop fastener. Similarly, restraining wedge 112 includes portions (described in detail below) covered with a hook (or loop) material of the hook and loop fastener. The hook and loop fastener is ideal for this application because the hook material may be fastened to the loop material with the application of only a small force, while a much greater force is required to remove or separate the hook material from the loop material. Thus, a golfer can place a forearm cuff 110 on each arm and then couple the forearm cuffs to the restraining wedge without the assistance of another person. The adherence provided by the hook and loop fastener is then strong enough to withstand the forces imparted on the juncture between forearm cuffs 110 and restraining wedge 112 during a full golf swing.

The forces imparted on the juncture of the hook and loop fastener will vary from golfer to golfer. For example, a professional golfer having a proper golf swing will feel little restriction from training device 100 because her full golf swing will be proper. Accordingly, the securing element securing forearm cuff 110 to restraining wedge 112 is not required to withstand a great force. In contrast, an amateur will likely feel significant restriction as she attempts to deviate from a proper swing. Thus, the adherence of the securing element must be greater. In the case of the hook and loop fastener, the configuration and size of the hooks and loops may be selected based on required durability and fastening strength.

In alternate embodiments of the present invention, it may be possible to replace the hook and loop fastener with other securing elements such as magnets and magnetically attracted materials, reusable adhesive materials, surface tension adhesives, snapping devices and the like. The inventors contemplate one alternate embodiment in which a bayonet-type coupling could be used for the securing element. With a bayonet-type coupling, each forearm cuff 110 could be provided, for example, with a male track element configured to mate with a female track element mounted on restraining wedge 112. The male and female elements could be mated or coupled by sliding them together in the direction of the corresponding arms's axis 104 or 106. Such a bayonet-type coupling could provide sufficient coupling strength in a direction perpendicular to the axis 104 or 106 while remaining straightforward to couple without the assistance of another person.

Figure 4:
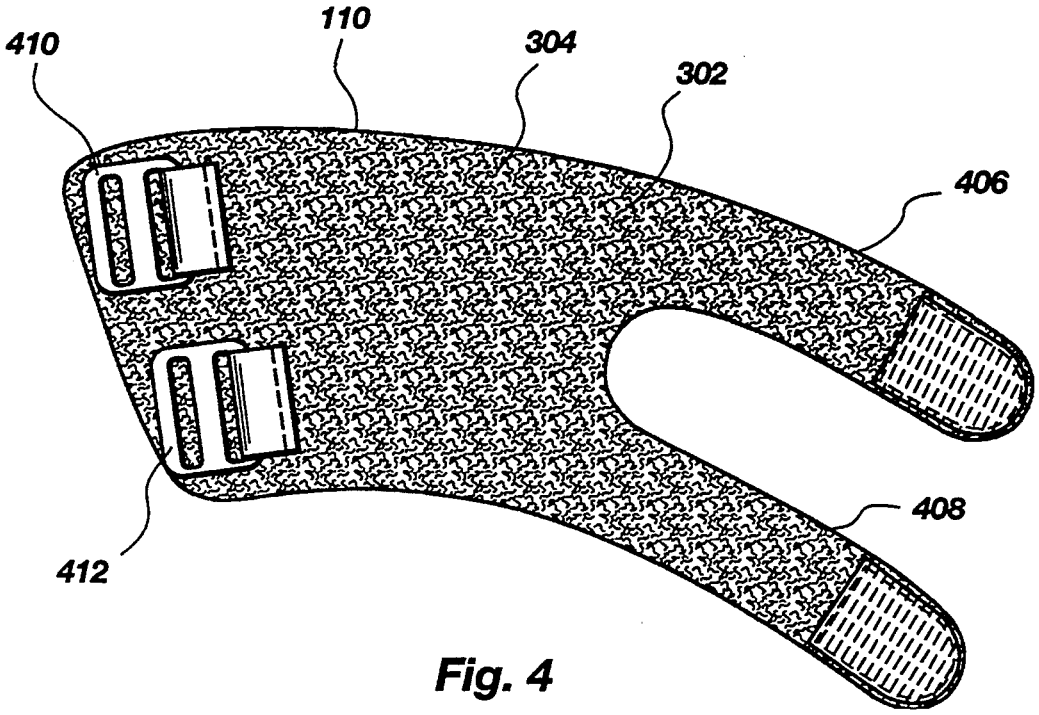
FIG. 4 shows a first embodiment of a forearm cuff of the invention.

A first preferred embodiment of forearm cuff 110 is illustrated in FIG. 4, and a second preferred embodiment of forearm cuff 110 is shown in FIG. 5. In either case, forearm cuff 110 is formed from a foam pad covered with a elastic materials. An exterior surface 302 is covered with a loop (or hook) material 304 of a hook and loop fastener. The other side of forearm cuff 110 may be covered with a terry material to provide comfort to the wearer.

In the embodiment shown in FIG. 4, forearm cuff 110 includes tongue-shaped extensions 406,408 and corresponding buckles 410,412. Tongue-shaped extension 406 is configured to mate with buckle 410. Tongue-shaped extension 408 is configured to mate with buckle 412.

Figure 5A:
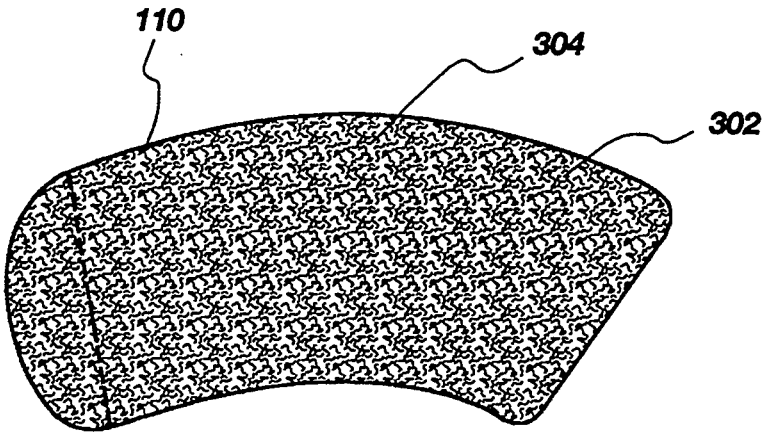
FIGS. 5A and 5B illustrate a second embodiment of a forearm cuff of the invention.
Figure 5B:
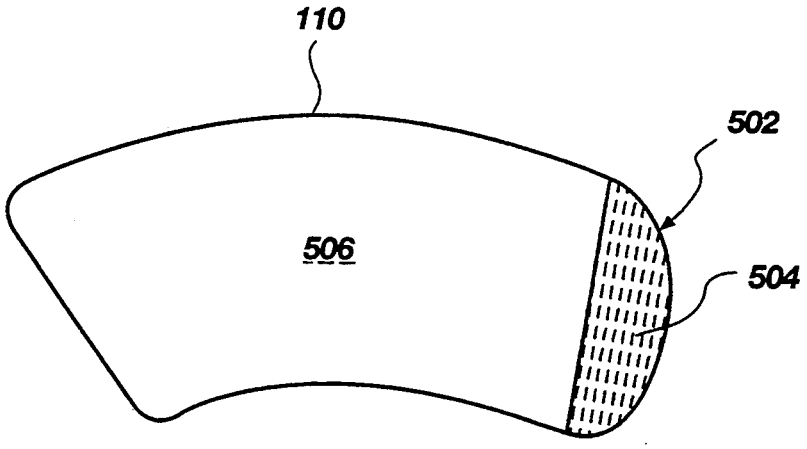

In the embodiment of FIG. 5, a hook and loop fastener is additionally used to secure forearm cuff 110 to the forearm of the golfer/wearer. FIG. 5A illustrates an exterior surface of forearm cuff 110 bearing loop (or hook) material 304. FIG. 5B shows the opposite side of forearm cuff 110. As illustrated, an end-portion 502 is covered with a hook (or loop) material 504 of a hook and loop fastener. Thus, this embodiment of forearm cuff 110 may be wrapped around a wearer's forearm and hook material 504 used to mate with loop material 304 of the exterior surface 302 of forearm cuff 110 to secure forearm cuff 110 around the wearer's forearm.

Referring back to FIG. 3, retaining wedge 112 includes a wedge element 306 and forearm receiving cuffs 308. Each forearm receiving cuff 308 is configured to mate with the forearm of a golfer wearing forearm cuff 110. Wedge element 306 fixedly attaches forearm cuffs 308 and maintains the proper inclination and skew angles therebetween. This embodiment of restraining wedge 112 may be made from a variety of different materials and manufacturing processes. For example, restraining wedge 112 may be injection-molded from an engineering plastic.

As discussed above, it is desirable to change inclination angle $\theta$ of restraining wedge 112 for different golfers. Similarly, it may be desirable to adjust skew angle $\alpha$ of restraining wedge 112 based on the type of swing being made as well as body size. For example, when hitting a ball with a driver (for the "long game"), it may be desirable to increase the skew angle to allow fuller body rotation for increased transmission of power.

To accommodate such adjustment of inclination and skew angles in the embodiment depicted in FIGS. 1 and 3, training device 100 may be manufactured in different angle increments. Alternatively, in a preferred embodiment described below, the inclination and skew angles as well as the perpendicular distance between the forearm receiving cuffs are fully adjustable. This preferred embodiment of the invention is illustrated in FIGS. 6–9.

Figure 6:
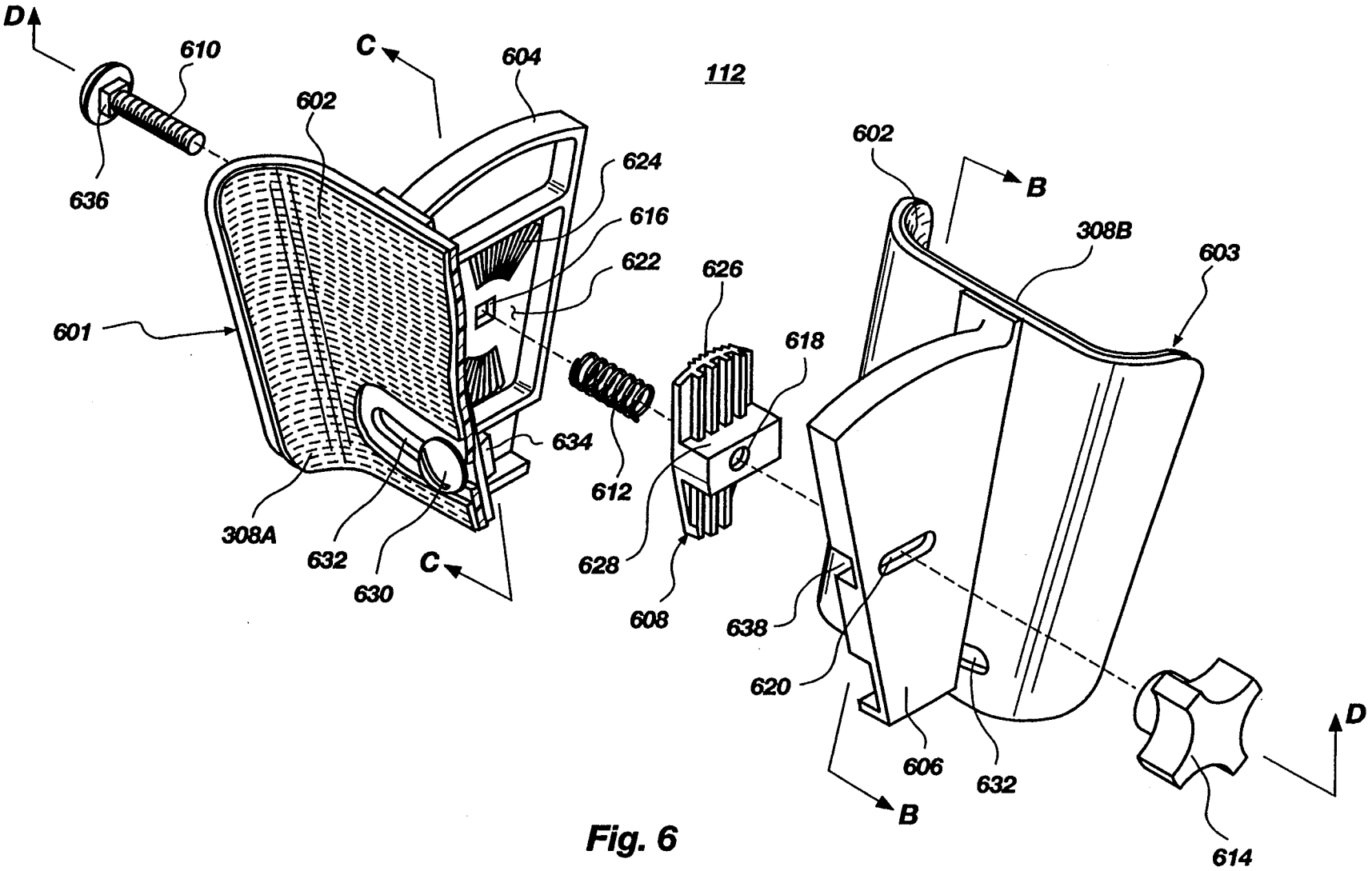
FIG. 6 is an exploded view of a second embodiment of the restraining wedge of the present invention.

Referring now to FIG. 6, restraining wedge 112 is shown in an exploded view. Restraining wedge 112 includes forearm receiving cuff assemblies 601,603, bolt 610, spring 612, key 608 and knob 614. Each forearm receiving cuff assembly includes a structural member 604 and a forearm cup 308. The interior surface of each forearm receiving cuff 308 is covered with a hook (or loop) material 602 of a hook and fastener, as discussed above. In this embodiment, wedge element 306 is implemented with structural members 604,606, key 608, bolt 610, spring 612, and knob 614. Bolt 610 is passed through a hole 616 of structural member 604, through spring 612, through a hole 618 in key 608, through a slot 620 in structural member 606 and is threaded into knob 614. Structural members 604 and 606 are secured together by tightening knob 614. Note that hole 616 has a square cross-section and bolt 610 has a shank portion 636 with a corresponding square cross-section. Shank portion 636 of bolt 610 mates with hole 616 to prevent bolt 610 from turning while knob 614 is tightened or loosened.

Figure 7:
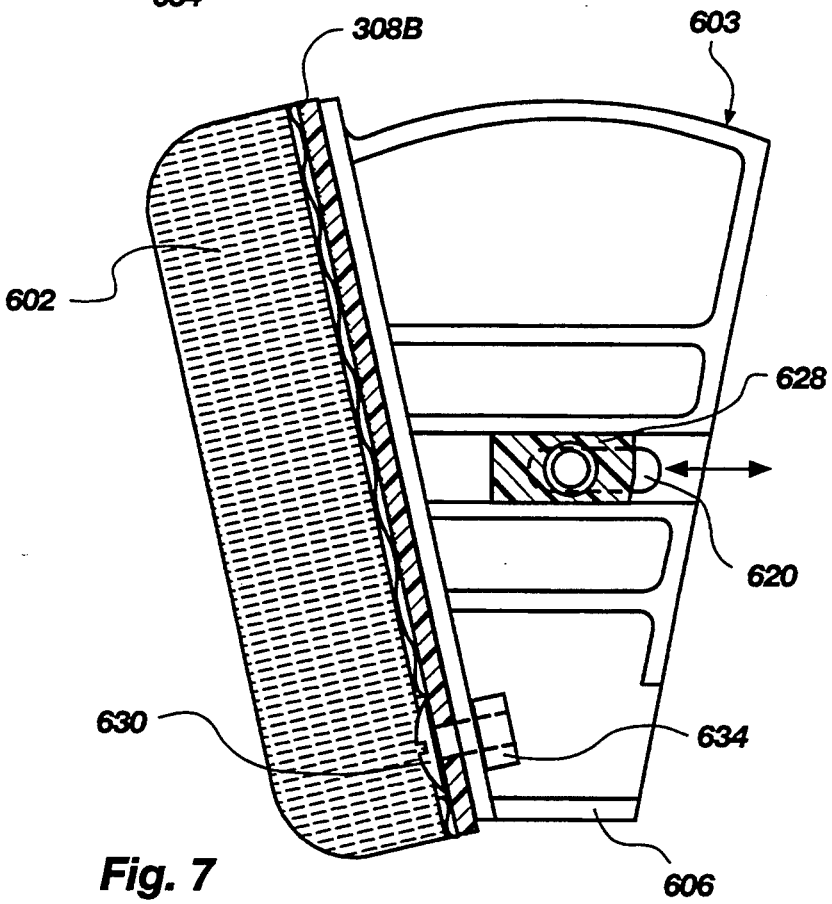
FIG. 7 is a cross-sectional view of the forearm receiving cuff assembly 603 taken across line B—B of FIG. 6.

The distance between forearm cups 308 can be adjusted by loosening knob 614 and sliding structural member 606 with respect to structural member 604 such that bolt 610 is moved within slot 620. This is illustrated in FIG. 7, which is a cross-sectional view of forearm receiving cuff assembly 603 taken across line B—B of FIG. 6.

Figure 8:
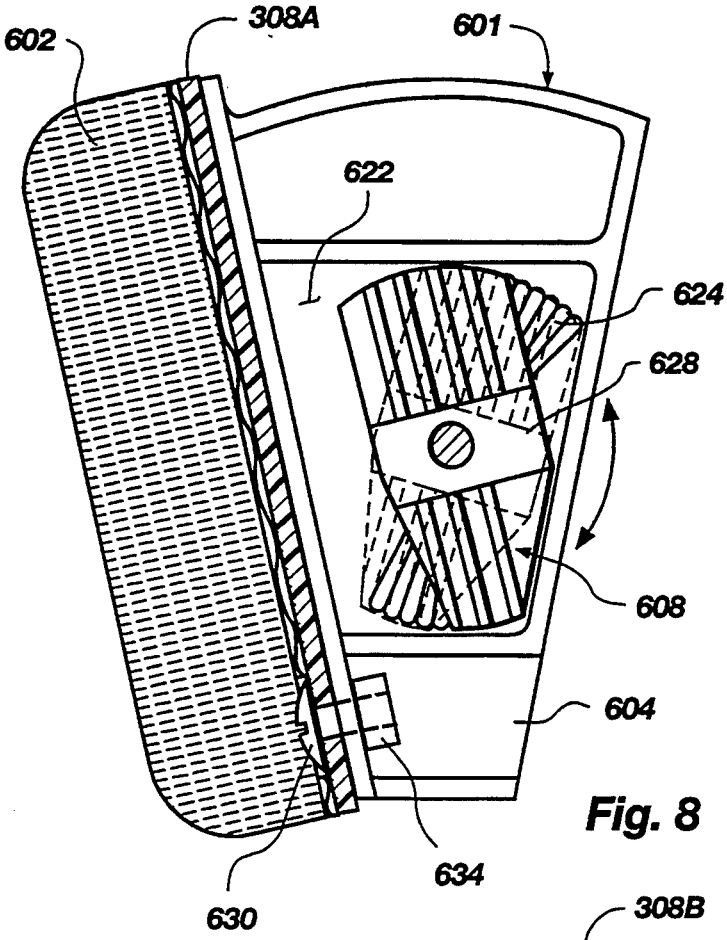
FIG. 8 is a cross-sectional view of forearm receiving cuff assembly 601 taken across line C—C of FIG. 6.

Inclination angle $\theta$ is adjusted by pivoting structural member 604 with respect to structural member 606 about bolt 610. Referring to FIGS. 6 and 8, key 608 includes a shank portion 628 having a substantially rectangular cross-section. Shank portion 628 is configured to mate with a slot 638 of structural member 606 so that key 608 will rotate with structural member 606. Structural member 604 includes a hollow central portion 622 having a ridged surface 624. Key 608 includes ridges 626 configured to mate with ridged surface 624 of structural member 604. Thus, when knob 614 is tightened to draw structural member 604 in contact with structural member 606, ridges 626 of key 608 mate with ridged surface 624 of structural member 604, and shank portion 628 of key 608 mates with slot 638 to fix the inclination angle at a desired setting and prevent undesired movement or slippage without requiring excessive tightening of knob 614.

Figure 9:
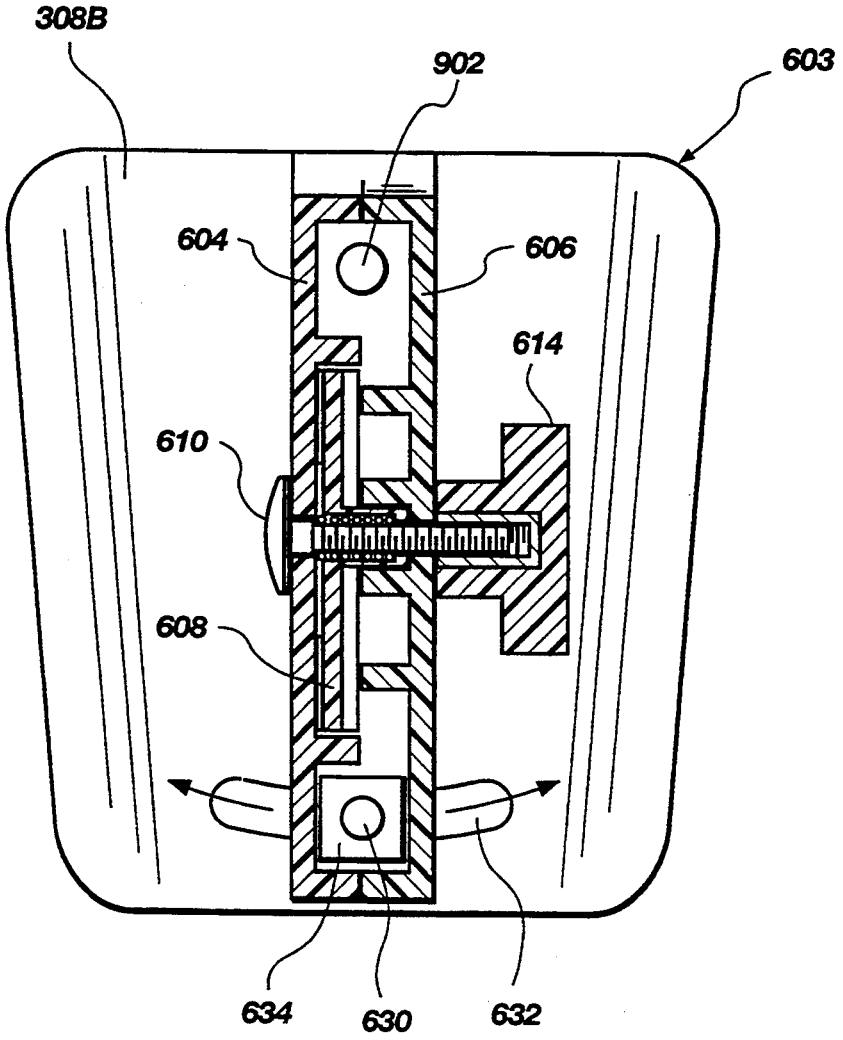
FIG. 9 is a cross-sectional view taken across line D—D of FIG. 6 of a fully assembled restraining wedge 112.

Referring to FIGS. 6 and 9, each structural member 604,606 is attached to the corresponding forearm cup 308 by a pivot pin 902 (not shown in FIG. 6) and an arrangement of a bolt 630 and a curved slot 632. Forearm cup 308 may be pivoted about pivot pin 902 by moving forearm cup 308 such that bolt 630 slides along curved slot 632. This movement allows skew angle $\alpha$ to be adjusted. Bolt 630 may be tightened into a mating nut 634 to secure forearm cup 308 with respect to structural member 604,606. Nut 634 is prevented from turning by the closely adjacent wall of the corresponding structural member 604,606. Alternatively, a tab (not shown) may be formed in the wall of structural members 604,606 to prevent nut 634 from rotating when bolt 630 is tightened.

In the preferred embodiment, training device 100 allows adjustment of the skew angle of each forearm cup 308 through a range of $\pm 15°$ for a total skew angle of 30° being possible between axes 104,106. Similarly, the inclination angle is adjustable at least between 24° and 36° (included angle). Each forearm cup 308 has a tapered shape as depicted in FIG. 6 to couple with one of forearms cuffs 110. Each forearm cup 308 has a narrow end width of approximately 3.5 inches and a wide end width of approximately 4.0 inches. Forearm cups 308 have a nominal medial separation in the range of approximately 2.25 to 3.0 inches, depending on the adjusted position of bolt 610 in slot 620.

In an alternate preferred embodiment, each forearm cup 308 may be made with a more curved shape than that depicted in FIG. 6 to eliminate the substantially flat medial portion of the cup as depicted. A more curved shape will enhance the mating fit of cup 308 and forearm cuff 110.

In the preferred embodiment, forearm cups 308, structural members 604,606 and key 608 are injection molded from an engineering plastic such as polycarbonate. The hook (or loop) material is secured to the inner surface of each cup 308 using an adhesive. The preferred hook and loop fastener (having sufficient durability and fastening strength) includes hook part number 88 and loop part number 3001, available from U.S. Velcro Inc., Sales and Marketing Headquarters, Manchester, N.H.

Figure 10A:
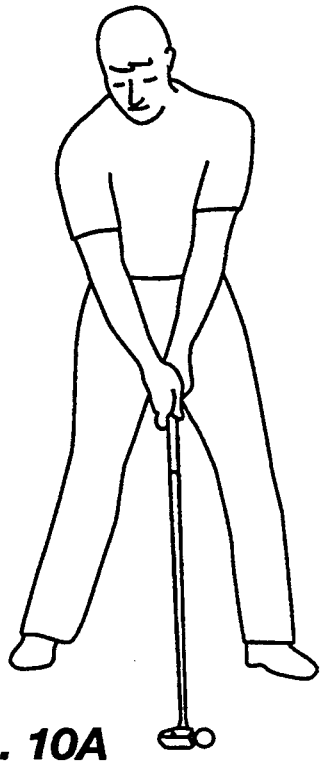
FIGS. 10A–10E illustrate an uncorrected amateur's golf swing.
Figure 10B:
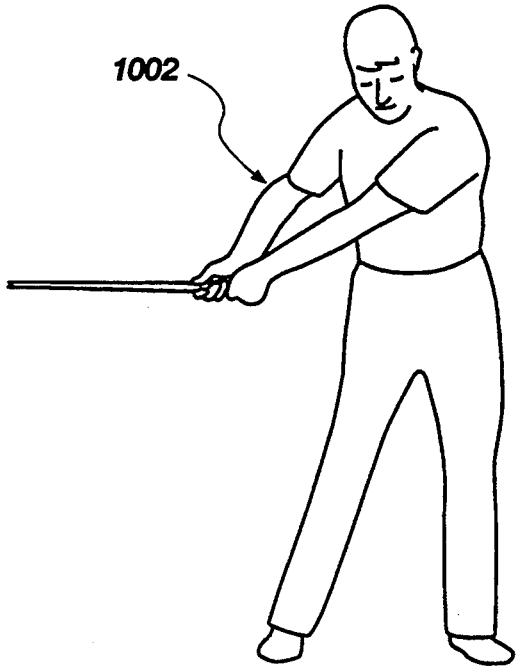

Use of training device 100 of the invention is described with reference to FIGS. 10 and 11. Referring first to FIG. 10, an uncorrected amateur's golf swing is illustrated. In FIG. 10A, the golfer is shown in the setup or address position. Note the triangle formed between the golfer's forearms. This triangle should be maintained throughout the full golf swing. FIG. 10B illustrates the golfer in the take-away position as he starts the backswing. Note, as indicated by reference number 1002, that the golfer has lifted his right arm and has pulled it out of the plane of the triangle present at setup. This undesirable movement is known as "coming out of plane."

Figure 10C:
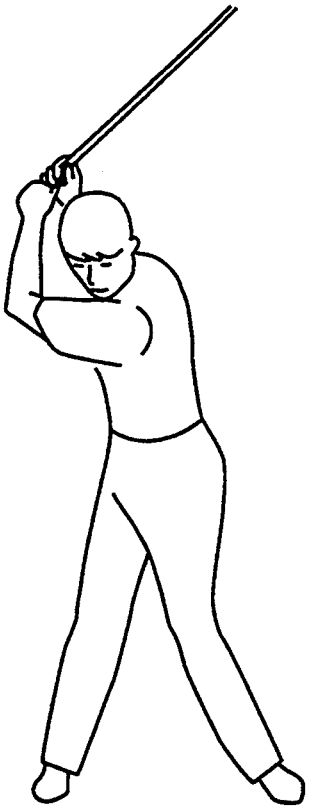

FIG. 10C illustrates the golfer with the club positioned at the top of his backswing. Note, that the golfer has now separated his forearms. His swing is being initiated from the top of the backswing by throwing the arms and shoulders out away from the body and by allowing the wrists to break from the top of the backswing. Throwing the arms and shoulders away from the body is known as "coming over the top." Breaking the wrists is known as "casting the club from the top." Both of these undesirable moves are caused by the intervention of small muscles of the hands and arms during the golf swing to manipulate the club into the hitting position at impact. The amateur commits these errors in an attempt to put power into the golf swing. However, the result is not to put power into the swing, but reduce power and control, because the weaker muscles of the hands and arms are being used rather than the stronger muscles of the legs, shoulders and torso.

Figure 10D:
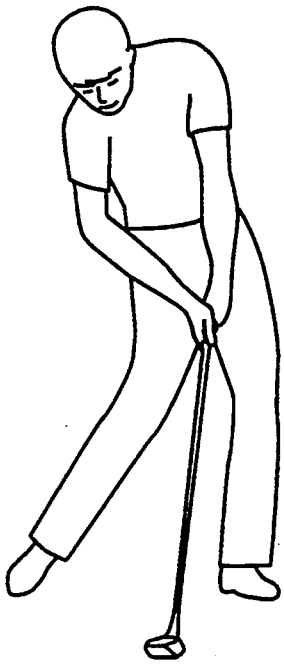

FIG. 10D illustrates the golfer's body position at impact. Note that the arms have separated, making it more difficult to square the club's face to the ball.

Figure 10E:
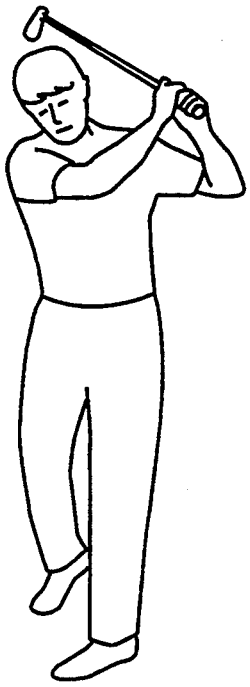

FIG. 10E illustrates the golfer's body position upon completion of the follow through. Note that the golfer's body remains substantially forward facing as it has throughout the setup, take-away, back swing and impact. His balance is poor and his arms have separated. Note also that the golfer has now lifted both arms out of plane.

Referring now to FIG. 11, a proper golf swing as taught by training device 100 is illustrated. To allow a proper golf swing, training device 100 permits the elbows to bend and fold during the swing, but prevents the golfer from "breaking plane." Training device 100 also immobilizes the smaller muscles of the hands and arms to ensure that the golf swing results from rotation of the shoulders around an axis through the spine of the golfer. Rotation of the shoulders in this manner involves leg and torso muscles as well as shoulder muscles, but minimizes involvement of arm and hand muscles.

Figure 11A:
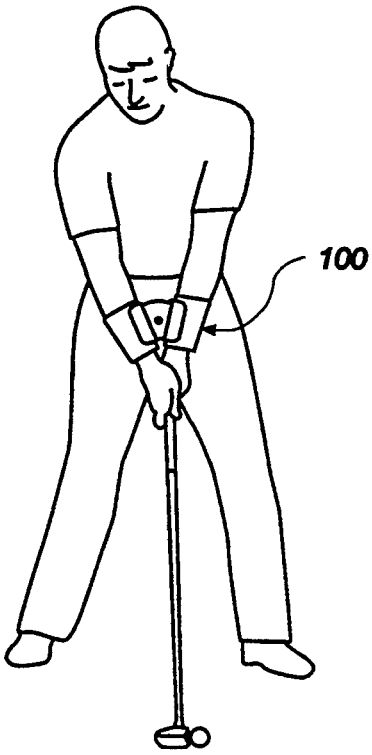
FIGS. 11A–11E illustrate an amateur's golf swing as corrected by the full golf swing training device of the present invention.
Figure 11B:
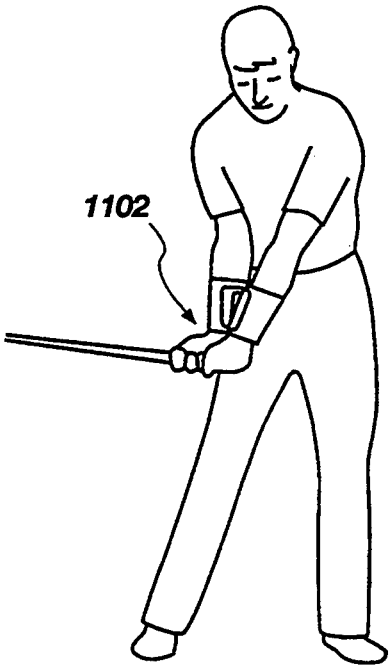

In FIG. 11A, the golfer is shown in the setup or address position. Again, note the triangle formed by the properly positioned forearms (and shoulders during set up). In FIG. 11B, the golfer is shown in the take-away body position. Note, in contrast to FIG. 10B, that the golfer has not lifted his right elbow. Rather, the golfer maintains proper positioning of his arms and shoulders but cocks his wrists as indicated by reference number 1102. Because training device 100 secures the arms together, the golfer is not able to lift his right arm separate from his left arm.

Figure 11C:
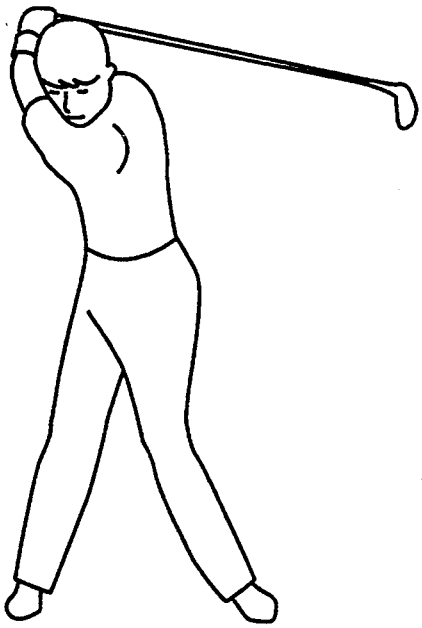

FIG. 11C shows the golfer's body position at the top of his back swing. Note, in contrast to FIG. 10C, that the golfer's left elbow has broken only slightly and that his wrists have not separated. In addition, both arms remain "in plane."

Figure 11D:
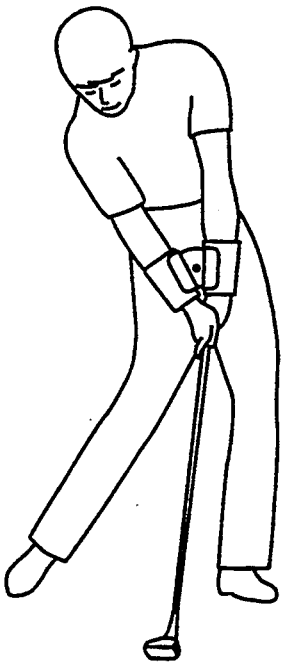
Figure 11E:
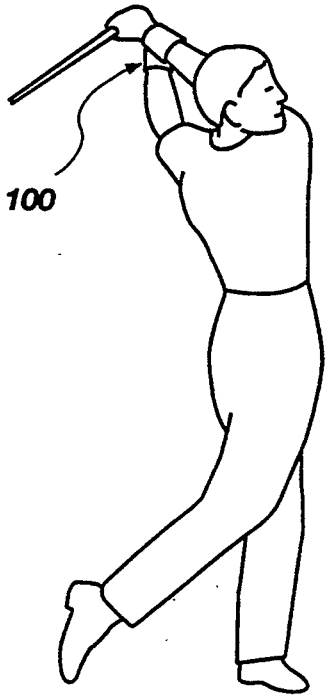

In FIG. 11D, the golfer's body position is shown at impact. Note that the arms (and shoulders) have maintained the same triangle as originally positioned during setup as shown in FIG. 11A. In addition, the wrists have returned from their cocked position to impart maximum energy to the golf ball. Because the arms have remained in plane, rotation of the golf club around the body has required use of the larger muscle groups of the back, torso and legs, rather than the smaller muscles groups of the hands and arms. This also results in a maximum transfer of energy to the golf ball. This is illustrated best in FIG. 11E which shows the golfer in the follow-through position. Note that the hips and shoulders are fully rotated while the triangle positioning of the arms is maintained. In addition, training device 100 has not restricted the golfer's arm roll. That is, he is able to fully rotate his arms from the shoulders for a smooth swing.

While the invention has been particularly shown and described with reference to several preferred embodiments thereof, a person skilled in the relevant art will recognize many variations to these embodiments. For example, one of the forearm cuffs may be permanently mounted to the restraining wedge such that the entire wedge is mounted to one of the golfer's forearms when the mounted cuff is worn. Similarly, one or both of the forearm cuffs may be produced in a rigid, hinged, clamshell style embodiment with air-inflatable inserts for adjusting fit. These and other variations in form and detail may be made therein without departing from the spirit and scope of the invention as defined in the appended claims.

What is claimed is:

1. A golf swing training device for setting and maintaining proper arm position throughout a full golf swing, comprising:

a restraining wedge for maintaining arm positioning when the wedge is held between a golfer's separated forearms;

first securing means for securing one of said golfer's forearms to said restraining wedge; and second securing means for enabling said golfer to removably secure the other one of said golfer's forearms to said restraining wedge without assistance from another person after said one forearm is already secured to said wedge by said first securing means.

2. The golf swing training device of claim 1, wherein said second securing means comprises:

a forearm cuff to be worn on the golfer's forearm;

a first securing element attached to said restraining wedge; and a second securing element attached to said forearm cuff, wherein a first force is required to securely couple said first and second securing elements and a second force is required to uncouple said first and second securing elements, said second force being greater than said first force.

3. The golf swing training device of claim 2, wherein said first and second securing elements comprise:

a hook and loop fastener.

4. The golf swing training device of claim 1, wherein each of said first and second securing means comprises:

a forearm cuff to be worn on the golfer's forearm;

a first securing element attached to said restraining wedge; and a second securing element attached to said forearm cuff, wherein a first force is required to securely couple said first and second securing elements and a second force is required to uncouple said first and second securing elements, said second force being greater than said first force.

5. The golf swing training device of claim 4, wherein said first and second securing elements comprise:

a hook and loop fastener.

6. The golf swing training device of claim 1, wherein said restraining wedge comprises:

a first forearm cup having an inner surface covered with a first mating component of a hook and loop fastener, a second forearm cup having an inner surface covered with a first mating component of a hook and loop fastener, and a wedge element coupling said first and second forearm cups;

and wherein each of said first and second securing means comprises:

a forearm cuff, and a second mating component of said hook and loop fastener disposed on an exterior surface of said forearm cuff.

7. The golf swing training device of claim 1, wherein said restraining wedge comprises:

a first forearm cup defining a first axis;

a second forearm cup defining a second axis;

a wedge element coupling said first and second forearm cups;

first adjustment means for adjusting a perpendicular separation between said first and second forearm cups; and second adjustment means for adjusting an inclination angle between said first and second axes.

8. The golf swing training device of claim, 7, wherein said restraining wedge further comprises:

third adjustment means for adjusting a skew angle between said first and second axes.

9. A golf swing training device for setting and maintaining proper arm position throughout a full golf swing, comprising:

first holding means, defining a first axis, for holding a golfer's first forearm in alignment with said first axis;

second holding means, defining a second axis, for holding the golfer's other forearm in alignment with said second axis; and means for coupling said first holding means to said second holding means such that a triangle is approximately formed by the forearms of the golfer when the golfer's forearms are held by said first and second holding means, and such that said first and second axes are skew.

10. The golf swing training device of claim 9, wherein at least one of said first and second holding means comprises:

a forearm cup;

a forearm cuff; and means for securing said forearm cuff to said forearm cup.

11. The golf swing training device of claim 10, wherein said securing means comprises:

a hook and loop fastener.

12. The golf swing training device of claim 11, wherein an exterior surface of said cuff is covered with a loop material of said hook and loop fastener, and wherein an inner surface of said receiving cup is covered with a hook material of said hook and loop fastener.

13. The golf swing training device of claim 9, wherein each of said first and second holding means comprises:

a forearm cup;

a forearm cuff; and means for securing said forearm cuff to said forearm cup.

14. The golf swing training device of claim 12, wherein said securing means comprises:

a hook and loop fastener.

15. The golf swing training device of claim 14, wherein an exterior surface of said cuff is covered with a loop material of said hook and loop fastener, and wherein an inner surface of said receiving cup is covered with a hook material of said hook and loop fastener.

16. The golf swing training device of claim 9, wherein said coupling means further comprises:

first adjustment means for adjusting a perpendicular separation between said first and second securing means; and second adjustment means for adjusting an inclination angle between said first and second axes.

17. The golf swing training device of claim 16, wherein said coupling means further comprises:

third adjustment means for adjusting a skew angle between said first and second axes.

18. The golf swing training device of claim 17, wherein at least one of said first and second securing means comprises:

a forearm cup;

a forearm cuff; and means for securing said forearm cuff to said forearm cup.

19. The golf swing training device of claim 18, wherein said securing means comprises:

a hook and loop fastener.

20. The golf swing training device of claim 19, wherein an exterior surface of said cuff is covered with a loop material of said hook and loop fastener, and wherein an inner surface of said receiving cup is covered with a hook material of said hook and loop fastener.

21. A golf swing training device for setting and maintaining proper arm position throughout a full golf swing, comprising:

a restraining wedge for maintaining a triangle between a golfer's forearms when the wedge is held between the golfer's forearms, said restraining wedge including first forearm cup having an inner surface covered with a first mating portion of a hook and loop fastener, second forearm cup having an inner surface covered with a first mating portion of a hook and loop fastener, and a wedge element coupling said first and second forearm cups;

a first forearm cuff having an outer surface covered with a second mating portion of said hook and loop fastener, said first forearm cuff for removable mating with said first forearm cup of said restraining wedge; and a second forearm cuff having an outer surface covered with a second mating portion of said hook and loop fastener, said second forearm cuff for removable mating with said first forearm cup of said restraining wedge.

22. The golf swing training device of claim 21, wherein said restraining wedge is configured such that a first axis of said first forearm cup and a second axis of said second forearm cup are skew.

23. The golf swing training device of claim 22, wherein said restraining wedge further comprises:

first adjustment means for adjusting a perpendicular separation between said first and second forearm cups and for adjusting an inclination angle between said first and second axes; and second adjustment means for adjusting said skew angle between said first and second axes.

24. The golf swing training device of claim 23, wherein said wedge element comprises:

a first structural member attached to an outer side of said first forearm cup at a first end by a pivot pin and at a second end by a bolt and slot arrangement;

a second structural member attached to an outer side of said second forearm cup at a first end by a pivot pin and at a second end by a bolt and slot arrangement;

a key disposed between said first and second structural members, said key having ridges for mating with a ridged area of said first structural member and having a shank portion for mating with a slot of said second structural member when said first and second structural members are brought together;

a bolt passing through a hole in a medial portion of said first structural member, a hole in said key, and a slot in a medial portion of said second structural member; and a threaded knob for use with said bolt to secure said first and second structural members together.

25. The golf swing training device of claim 24, wherein said wedge element further comprises:

a coil spring disposed between said first and second structural members.

* * * * *

UNITED STATES PATENT AND TRADEMARK OFFICE

CERTIFICATE OF CORRECTION

PATENT NO. : 5,447,312

DATED : September 5, 1995

INVENTOR(S) : Nixon et al

It is certified that error appears in the above-indentified patent and that said Letters Patent is hereby corrected as shown below:

In Column 2, line 59, replace "cuffs" with --cups--.

In Column 2, line 68, after "angle", insert --of--; and replace "cuff" with --cup--.

In Column 3, line 22, replace "cuffs" with --cups--.

In Column 3, line 48, replace "cuff assembly" with --cup assembly--.

In Column 3, line 50, replace "cuff assembly" with --cup assembly--.

In Column 6, line 29, replace "cuffs" with --cups--.

In Column 6, line 30, replace "cuff" with --cup--.

UNITED STATES PATENT AND TRADEMARK OFFICE

CERTIFICATE OF CORRECTION

PATENT NO. : 5,447,312

DATED : September 5, 1995

INVENTOR(S) : Nixon et al

It is certified that error appears in the above-indentified patent and that said Letters Patent is hereby corrected as shown below:

In Column 6, line 32, replace "cuffs" with --cups--.

In Column 6, line 53, replace "cuffs" with --cups--.

In Column 6, line 57, replace "cuff assemblies" with --cup assemblies--.

In Column 6, line 59, replace "cuff assembly" with --cup assembly--.

In Column 6, line 61, replace "cuff" with --cup--.

In Column 7, line 13, replace "cuff assembly" with --cup assembly--.

Signed and Sealed this

Twenty-second Day of July, 1997

Bruce Lehman

*Attest:*

BRUCE LEHMAN

*Attesting Officer*

*Commissioner of Patents and Trademarks*